US006231393B1

(12) United States Patent
Lai

(10) Patent No.: US 6,231,393 B1
(45) Date of Patent: May 15, 2001

(54) ELECTRICAL CONNECTOR

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,343

(22) Filed: Dec. 29, 1999

(51) Int. Cl.[7] ..... H01R 13/648
(52) U.S. Cl. ..... 439/610
(58) Field of Search ..... 439/606–610

(56) References Cited

U.S. PATENT DOCUMENTS

| | | | | |
|---|---|---|---|---|
| 5,683,269 | * | 11/1997 | Davis et al. | 439/607 |
| 5,938,476 | * | 8/1999 | Wu et al. | 439/610 |
| 5,944,559 | * | 8/1999 | Wu | 549/607 |
| 5,961,351 | * | 10/1999 | Wu | 439/610 |
| 6,039,606 | * | 3/2000 | Chiou | 439/610 |

* cited by examiner

*Primary Examiner*—Gary F. Paumen

(74) *Attorney, Agent, or Firm*—Wei Te Chung

(57) ABSTRACT

An electrical connector comprises an insulative housing, a plurality of terminals received in the housing, a one-piece conductive shell, and an over-molded casing portion. The plurality of terminals are secured within a plurality of receiving channels defined in the insulative housing. the terminals are of two designs, produced on two different carrier stripes. Both terminal designs include a mating portion at one end and a mounting portion at an opposite end. The designs differ in that the soldering portion is level with the mating portion in one design, and is at an elevation above the mating portion in the second design. Also, the soldering portions are laterally offset in opposite directions relative to the plane of the mating portions. Terminals of the two designs are assembled into the connector in an alternating pattern, creating larger distance between adjacent mounting portions. The one-piece shell includes a first wall, a second wall, a third wall, a fourth wall, and a mating portion all being integrally formed from a metal sheet and folded into a rectangular main body and a smaller rectangular mating portion. A pair of protrusions on opposite sides of the housing engage with a pair of second openings on opposite sides of the main body of the shell.

1 Claim, 3 Drawing Sheets

ELECTRICAL CONNECTOR

BACKGROUND OF THE INVENTION

The present invention relates to an electrical connector, and particularly to an electrical connector with a one-piece shell.

Taiwan Patent Application No. 88213348 discloses an electrical connector comprising an insulative housing having a plurality of terminal receiving channels retaining a corresponding number of terminals therein, and a shell covering outer faces of the insulative housing. Each terminal includes a solder tail for soldering to a cable and a mating portion for mating with a complementary connector. The terminals are produced on a common carrier strip and are all identical, so a distance between two adjacent terminals is very small, especially in a high-density connector. Therefore, the solder portions of the terminals are too difficult to attach to a cable. In addition, the fit of the insulative housing within the shell is not very firm because of their dove-tailed design.

Hence, an improved electrical connector is required to overcome the disadvantages of the prior art.

BRIEF SUMMARY OF THE INVENTION

A first object of the present invention is to provide an electrical connector having a one-piece shell.

A second object of the present invention is to provide an electrical connector wherein the soldering portions of two adjacent terminals are offset in opposite directions from the connector providing wider separation between soldering portions and more convenient soldering connections to wires.

To fulfill the above mentioned objectives, an electrical connector according with the present invention comprises an insulative housing, a plurality of terminals received in the housing, a one-piece conductive shell, and an over-molded casing portion. The plurality of terminals are secured within a plurality of receiving channels defined in the insulative housing. The terminals are of two designs, produced on two different carrier stripes. Both terminal designs include a mating portion at one end and a mounting portion at an opposite end. The designs differ in that the soldering portion is level with the mating portion in one design, and is at an elevation above the mating portion in the second design. Also, the soldering portions are laterally offset in opposite directions relative to the plane of the mating portions. Terminals of the two designs are assembled into the connector in an alternating pattern, creating larger distance between adjacent mounting portions. The one-piece shell includes a first wall, a second wall, a third wall, a fourth wall, and a mating portion all being integrally formed from a metal sheet and folded into a rectangular main body and a smaller rectangular mating portion. A pair of protrusions on opposite sides of the insulative housing engage with a pair of second openings on opposite sides of the main body of the shell.

Other objects, advantages and novel features of the invention will become more apparent from the following detailed description of the present embodiment when taken in conjunction with the accompanying drawings.

DETAILED DESCRIPTION OF THE INVENTION

Figure 1:
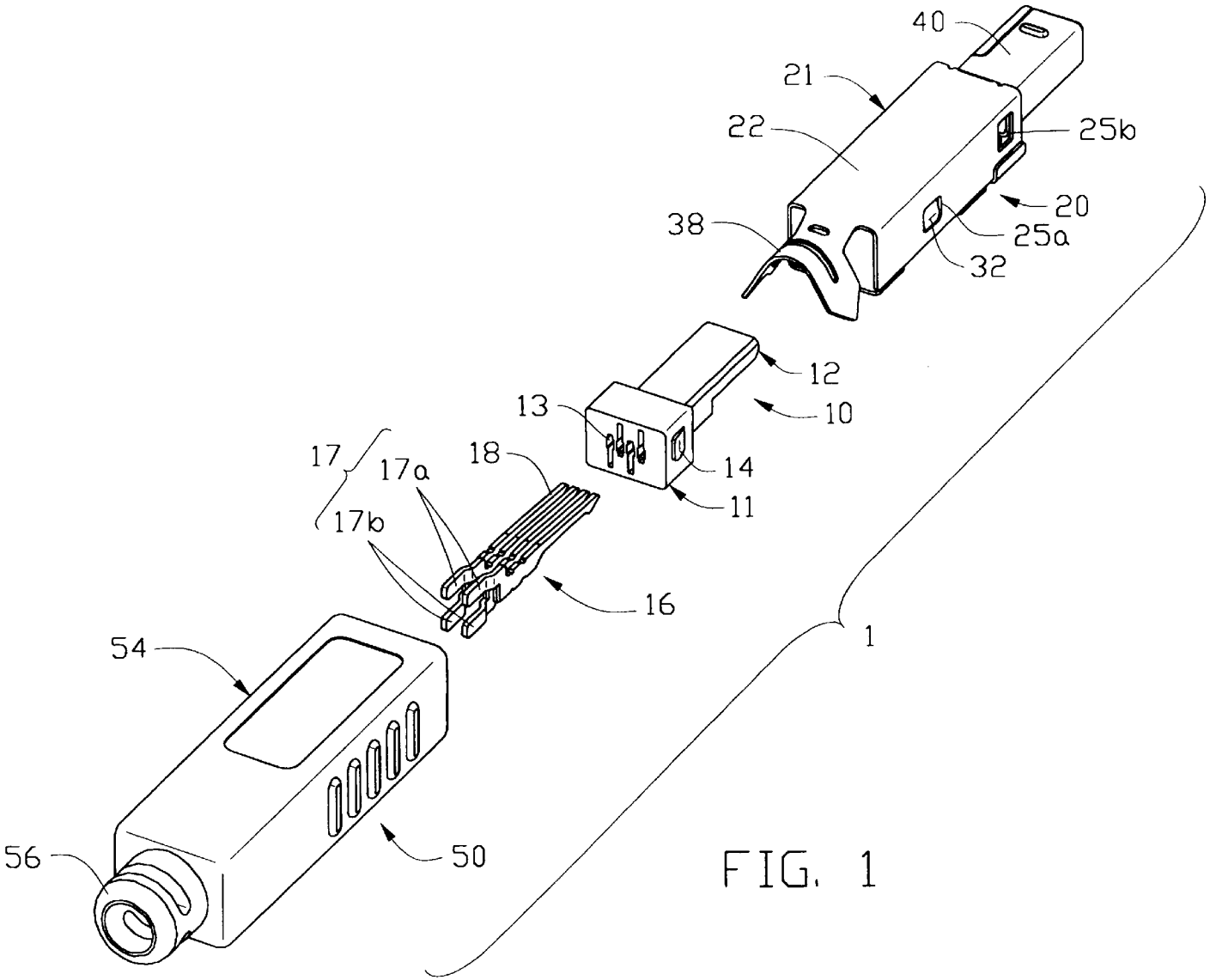
FIG. 1 is an exploded view of an electrical connector in accordance with the present invention.

Referring to FIG. 1, an electrical connector 1 in accordance with the present invention comprises an insulative housing 10, a plurality of terminals 16, a one-piece shell 20, and a casing portion 50 enveloping the one-piece shell. The insulative housing 10 has a first portion 11 and a second portion 12 connected to the first portion 11. A plurality of receiving channels 13 are arranged through the first portion 11 and the second portion 12 for accepting the corresponding terminals 16 therein. The first portion 11 forms a protrusion 14 on each side thereof.

Each terminal 16 comprises a soldering portion 17 on one end for soldering to a corresponding wire of a cable 60 (FIG. 3), and a mating portion 18 on an opposite end for contacting with a complementary connector (not shown). The terminals 16 are produced in two types, connected to two different carrier strips (not shown) and are then assembled into the housing 10 in an alternating pattern. Therefore, two types of soldering portions (17*a* and 17*b*), each angled in an opposite direction with respect to the mating portions 18, and each of a different elevation above the axis of the mating portions, have an increased distance between them in assembly. This larger distance between soldering portions 17 allows more convenient soldering to the wires of the cable 60.

Figure 2:
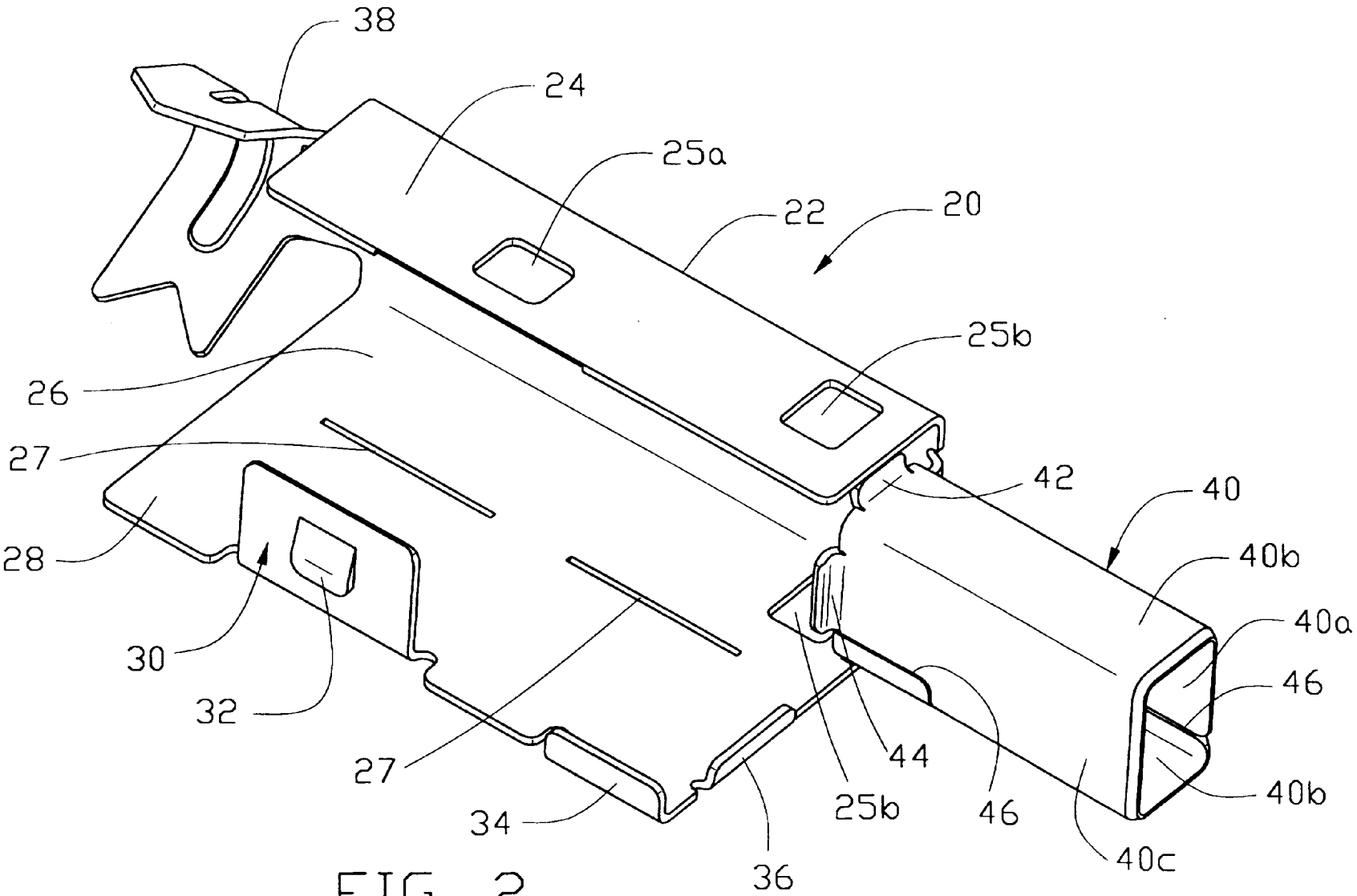
FIG. 2 is a perspective view of a shell of an electrical connector before completion of the bending process in accordance with the present invention.

Also referring to FIG. 2, the one-piece shell 20 is stamped and formed from a single sheet of metal and includes a main body 21 having a first wall 22, a second wall 24 extending downward from one edge of the first wall 22, a third wall 26 extending downward from an opposite edge of the first wall 22, and a fourth wall 28 integrally extending from one edge of the third wall 26. A first opening 25*a* is defined in the second wall 24 and two second openings 25*b* are defined in the second wall 24 and the third wall 26. The openings 25*b* receive the protrusions 14 of the first portion 11 of the housing 10 for securing the housing 10 in the shell 20. Two narrow slots 27 are defined between the third wall 26 and the fourth wall 28 to ease the bending operation.

An extending plate 30 perpendicularly extends from a distal edge of the fourth wall 28. The extending plate 30 forms a tongue 32 outwardly extending for securely retaining within the corresponding opening 25*a*. A first securing tab 34 and a second securing tab 36 are respectively formed at the distal edge and a forward edge of the fourth wall 28. The shell 20 further includes a crimping portion 38 at a rear end for crimping the cable 60 and a mating portion 40 at a front end for retaining the second portion 12 of the insulative housing 10 therein. A pair of first supporting tabs 42 and a second supporting tab 44 respectively bend outward from two sides and a bottom edge of the mating portion 40. The mating portion 40 of the shell 20 defines a junction line 46 extending along a top wall 41*a*, a side wall 40*b* and a bottom wall 40*c* thereof.

Figure 3:
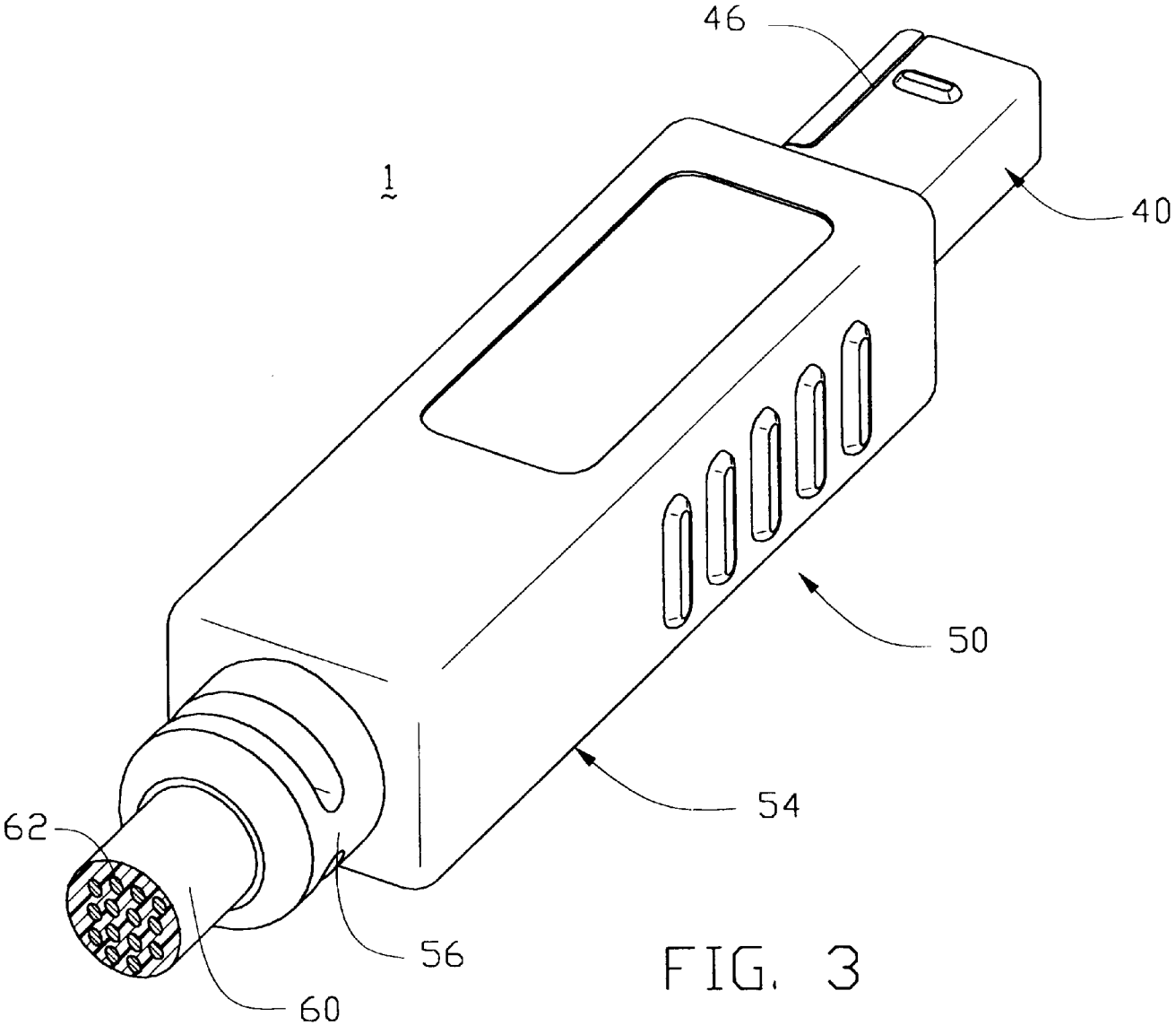
FIG. 3 is an assembled view of an electrical connector in accordance with the present invention.

Referring to FIG. 3, the casing portion 50 is over-molded about the shell 20. Said casing portion 50 includes a main body 54 and a strain relief 56 formed at an end of the main body 54. The cable 60 extends through the strain relief 56 and comprises a plurality of wires 62 for soldering to the corresponding terminals 16.

Referring to FIGS. 1 to 3, in assembly, the terminals 16 are inserted into the corresponding channels 13 from the first portion 11 of the insulative housing 10. The wires of the cable 60 are soldered to the soldering portions 17 of the terminals 16. The shell 20 is bended with the tongue 32 of the extending plate 30 engaging with the opening 25*a* of the second wall 24. The first securing tab 34 abuts an outside of the second wall 24, preventing the second wall 24 from releasing outward. The second scuring tab 36 abuts the second supporting tab 44, providing support to the mating portion 40 of the shell 20. The first supporting tab 42 provides support between the second wall 24, the third wall 26, and the mating portion 40. The insulative housing 10 is inserted into the shell 20, the second portion 12 of the insulative housing 10 extending into the mating portion 40 of the shell 20. The protrusions 14 of the insulative housing 10 are securely retained in the second openings 25*b* of the shell 20. The crimping portion 38 of the shell 20 is crimped about the cable 60. Finally, the casing portion 50 is over-molded over the shell 20, the mating portion 40 of the shell protruding from a front end of the casing portion 50.

One of the advantages of the present invention is that the process of soldering the terminals to the cable becomes more easy because of the increase in the distance between adjacent solder portions. The second advantage of the present invention is that the assembled one-piece shell 20 is stronger than the design of the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing having a first portion, a second portion integrally extending from the first portion, and a plurality of receiving channels therethrough;

a plurality of terminals secured within the receiving channels;

a one-piece shell having a first wall, a second wall, a third wall, a fourth wall, and a mating portion connected to the first wall, the mating portion receiving the second portion of the insulative housing, the second wall and the third wall engagingly retaining the first portion therein; and a casing portion over-molded about the shell;

wherein each terminal includes a soldering portion and a mating portion, the soldering portions of two adjacent terminals being offset in opposite directions relative to a plane defined by all terminals;

wherein at least one slot is defined between the third wall and the fourth wall to aid a bending operation;

wherein the fourth wall forms an extending plate thereof, the extending plate forming an outwardly protruding tongue, and the second wall defines a first opening for engagingly retaining the tongue;

wherein the fourth wall includes a first securing tab protruding from a first edge thereof for abutting an outside surface of the second wall;

wherein the mating portion forms a pair of first supporting tabs and a second supporting tab respectively in opposite side edges thereof and a bottom edge thereof, both edges adjacent the main body;

wherein the fourth wall includes a second securing tab extending from a second edge thereof adjacent the mating portion for engaging with the second supporting tab;

wherein the first portion of the insulative housing includes a protrusion on each of two lateral sides thereof, and the second and third walls of the shell each define a second opening for engagingly retaining the protrusions;

wherein the mating portion of the shell defines a junction line extending along a top wall, a side wall and a bottom wall thereof.

* * * * *